US007823600B2

(12) United States Patent
Laakso et al.

(10) Patent No.: US 7,823,600 B2
(45) Date of Patent: Nov. 2, 2010

(54) WATERPROOF SYSTEM FOR ATTACHING AN ANCHOR MEMBER TO A PORTION OF A TENT AND RELATED METHOD

(75) Inventors: Thomas Laakso, Piedmont, CA (US); Kye-Sun Choi, Yongin-si (KR)

(73) Assignee: The North Face Apparel Corp., Wilmington, DE (US)

( * ) Notice: Subject to any disclaimer, the term of this patent is extended or adjusted under 35 U.S.C. 154(b) by 0 days.

(21) Appl. No.: 10/369,770

(22) Filed: Feb. 21, 2003

(65) Prior Publication Data

US 2003/0178055 A1 Sep. 25, 2003

(51) Int. Cl.
*E04H 15/64* (2006.01)

(52) U.S. Cl. ..... 135/119; 135/115

(58) Field of Classification Search ..... 135/119, 135/115, 120.1, 120.3, 136, 906, 907, 117; 52/3, 4; 248/205.2, 205.4
See application file for complete search history.

(56) References Cited

U.S. PATENT DOCUMENTS

| | | | | | |
|---|---|---|---|---|---|
| 1,871,570 | A | * | 8/1932 | Weber | 52/3 |
| 2,591,829 | A | * | 4/1952 | Katzenmeyer et al. | 52/2.21 |
| 2,764,765 | A | * | 10/1956 | Woodruff, Sr. | 114/361 |
| 3,162,920 | A | * | 12/1964 | Durham | 24/265 R |
| 3,225,408 | A | * | 12/1965 | Durham | 24/265 R |
| 3,496,686 | A | * | 2/1970 | Bird | 52/2.25 |
| 3,598,133 | A | * | 8/1971 | Abert et al. | 135/94 |
| 3,986,519 | A | * | 10/1976 | Gillis | 135/125 |
| 4,033,366 | A | * | 7/1977 | Forget | 135/98 |
| 4,265,259 | A | | 5/1981 | Gillis | 135/127 |
| 4,305,414 | A | * | 12/1981 | Bareis | 135/116 |
| 4,308,647 | A | | 1/1982 | Gillis | 24/460 |
| 4,530,868 | A | * | 7/1985 | Shinmi et al. | 428/57 |
| 4,539,255 | A | * | 9/1985 | Sato et al. | 442/286 |
| 4,569,870 | A | * | 2/1986 | Shinmi | 428/57 |
| 4,768,317 | A | | 9/1988 | Markham | 52/74 |
| 4,858,635 | A | | 8/1989 | Eppenbach | 135/125 |
| 5,152,018 | A | * | 10/1992 | Lea | 5/420 |
| 5,205,086 | A | | 4/1993 | Heim | 52/2.13 |
| 5,240,756 | A | * | 8/1993 | Finell et al. | 428/45 |
| 5,421,355 | A | * | 6/1995 | Cantwell | 135/120.3 |
| 5,582,197 | A | | 12/1996 | Dobberstein | 135/87 |
| 5,606,986 | A | | 3/1997 | Muise | 135/87 |
| 5,638,850 | A | | 6/1997 | Hazinski et al. | 135/120.1 |
| 5,642,750 | A | | 7/1997 | Brown et al. | 135/137 |
| 5,655,558 | A | | 8/1997 | Child | 135/97 |

(Continued)

FOREIGN PATENT DOCUMENTS

| | | |
|---|---|---|
| GB | 2 071 564 | 9/1981 |

(Continued)

*Primary Examiner*—A. Joseph Wujciak, III
(74) *Attorney, Agent, or Firm*—Steptoe & Johnson LLP

(57) ABSTRACT

A system for providing an anchor member on a fabric portion of a tent, such as a tent body or a tent fly, includes an anchor member and an anchor patch sewn to at least a portion of the anchor member with threads. The anchor patch is laminated to the fabric portion of the tent without the threads extending through the fabric portion of the tent. A tent including such a system is also disclosed, as well as the method of providing the anchor member on the fabric portion of the tent.

28 Claims, 6 Drawing Sheets

U.S. PATENT DOCUMENTS

| | | | | |
|---|---|---|---|---|
| 5,771,912 | A * | 6/1998 | Swetish | 135/87 |
| 5,778,915 | A | 7/1998 | Zheng | 135/126 |
| 5,885,679 | A | 3/1999 | Yasue et al. | 428/57 |
| 6,021,796 | A | 2/2000 | Vavra | 135/147 |
| 6,209,557 | B1 | 4/2001 | Zheng | 135/126 |
| 6,219,888 | B1 | 4/2001 | Lynch | 24/115 R |
| 6,227,218 | B1 | 5/2001 | Breaux | 135/120.1 |
| 6,263,617 | B1 | 7/2001 | Turcot et al. | 52/2.18 |
| 6,279,208 | B1 | 8/2001 | Gillis | 24/342 |
| 6,470,901 | B1 | 10/2002 | Scherer | 135/136 |
| 6,474,022 | B1 * | 11/2002 | Double et al. | 52/3 |
| 6,497,934 | B1 * | 12/2002 | Mahn et al. | 428/57 |
| 6,499,497 | B1 * | 12/2002 | Swetish et al. | 135/115 |
| 6,681,785 | B2 * | 1/2004 | Choi | 135/115 |
| 7,267,135 | B2 | 9/2007 | Hardee et al. | 135/116 |
| 2001/0010232 | A1 | 8/2001 | Zheng | 135/126 |
| 2002/0020439 | A1 | 2/2002 | Tate | 135/124 |
| 2004/0173251 | A1 * | 9/2004 | Cantwell | 135/115 |

FOREIGN PATENT DOCUMENTS

| | | | |
|---|---|---|---|
| GB | 2254623 | A * | 10/1992 |
| WO | WO 03/033796 | A1 * | 4/2003 |

* cited by examiner

WATERPROOF SYSTEM FOR ATTACHING AN ANCHOR MEMBER TO A PORTION OF A TENT AND RELATED METHOD

FIELD OF THE INVENTION

The present invention relates generally to tents, and more specifically, to systems for anchoring a support member to a portion of a fabric sheet of a tent, and methods of forming such systems.

BACKGROUND OF THE INVENTION

The large segment of society that enjoys outdoor camping seeks a tent construction that provides increased portability and durability under extreme weather conditions. Campers seek not only shelter from external elements of wind, rain or snow, but they also desire adequate ventilation within the internal environment of the tent. To meet these needs, the typical tent construction includes a fabric tent body that is supported by a plurality of poles, with the tent body commonly having one or more mesh windows or vents, and a door. In order to maximize both the tent's weather resistance and ventilation, tents also commonly include a tent fly. A tent fly is an additional layer of fabric that is attached to the tent body and/or tent poles, with an open space formed between the tent body and the tent fly to provide for ventilation. The tent fly forms the outermost layer of the tent, and thus it is important that the tent fly is impervious to wind, rain, snow or any other external elements.

Tent flys are commonly attached to the tent poles using anchors such as loops of hook-and-loop fastener material, or clips attached to a length of webbing. Regardless of the specific type of anchor used, the anchor must be attached directly to the tent fly. This is commonly done by sewing a portion of the anchor directly to the tent fly. Direct sewing creates thread holes through the tent fly which may allow rain, melted snow, or wind to penetrate the tent fly. To minimize the adverse effects of the thread holes, tent manufacturers commonly apply one or more layers of waterproof fabric, commonly referred to as "seam tape", over the stitches. Providing seam tape over the stitches, however, does not always provide a sufficient barrier against the elements, especially in view of the high stresses that may be applied to the stitches in high wind conditions, which may cause the stitches to enlarge and/or tear the thread holes in the tent fly.

Thus, there remains a need in the art for a system that will permit stitchless, waterproof attachment of an anchor member to a tent fly or other portion of a tent. Additionally, such a system must maintain an adequate seal when the tent fly is subject to variable multi-axial load conditions, such as may be experienced during high winds. Finally, the system must be light weight, pliable, easily administered, strong, and must not unduly interfere with the transmission of light into the tent enclosure.

SUMMARY OF THE INVENTION

The present invention is directed to a system for providing an anchor member on a fabric portion of a tent. The system includes an anchor member, and an anchor patch sewn to at least a portion of the anchor member with threads. The anchor patch is laminated to the fabric portion of the tent without the threads extending through the fabric portion of the tent. The anchor patch may be laminated to the fabric portion of the tent with an adhesive, such as a polyurethane-based or polyester-based adhesive, disposed between the anchor patch and the fabric portion of the tent.

According to one aspect of the invention, a reinforcement patch may be disposed between the anchor patch and the fabric portion of the tent, wherein the anchor member is sewn to the anchor patch with threads that extend through the anchor patch and the reinforcement patch. In addition, the reinforcement patch may be laminated to the anchor patch with a layer of polyurethane-based or polyester-based adhesive disposed between the anchor patch and the reinforcement patch. The reinforcement patch may be smaller than the anchor patch, and may also be in shapes that adequately distribute stress and allow proper surface area for bonding, such as, for example, ellipses, circles or the like.

According to another aspect of the invention, the anchor member may be provided on a fabric tent body or tent fly. The tent body or tent fly may be constructed of a material that is lightweight, pliable, waterproof and/or translucent.

According to yet another aspect of the invention, the anchor patch may be laminated over a seam in the fabric portion of the tent, and a continuous layer of seam tape may extend along the seam and over or under the anchor patch.

The present invention is also directed to a method of attaching an anchor member to a tent. The method includes the steps of sewing the anchor member to an anchor patch, and laminating the anchor patch to a portion of the tent without creating any thread holes through the portion of the tent. For example, the step of laminating may include providing a layer of adhesive between the anchor patch and the portion of the tent, and heat welding the anchor patch and the portion of the tent together.

The method may also include the step of providing a reinforcement patch between the anchor patch and the portion of the tent, wherein the step of sewing the anchor member to the anchor patch comprises sewing through the anchor patch and the reinforcement patch. In addition, the reinforcement patch may be laminated to the anchor patch.

BRIEF DESCRIPTION OF THE DRAWINGS

The detailed description will be better understood in conjunction with the accompanying drawings, wherein like reference characters represent like elements, as follows.

DETAILED DESCRIPTION OF THE PREFERRED EMBODIMENTS

Figure 1:
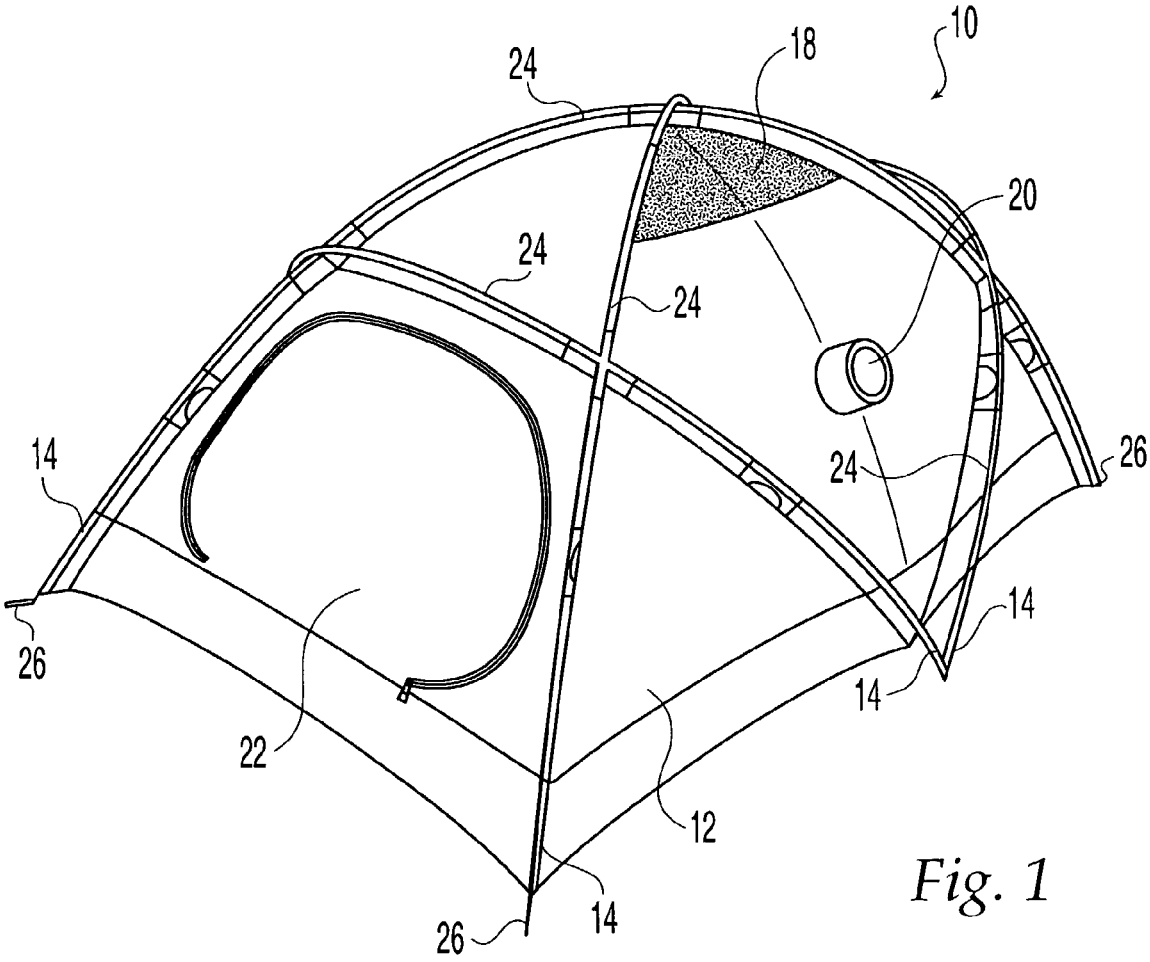
FIG. 1 is a perspective view of an illustrative embodiment of a tent according to the present invention.
Figure 2:
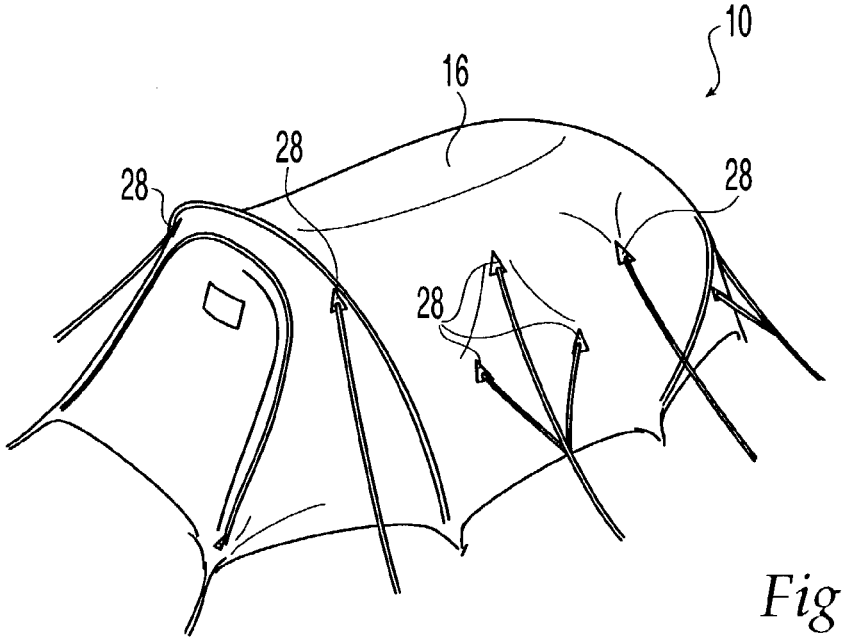
FIG. 2 is a perspective view of the tent of FIG. 1, with a tent fly installed.

Referring to FIGS. 1 and 2, an illustrative embodiment of a tent is shown. Tent 10 generally includes a fabric tent body 12, a plurality of poles 14 that form a frame for supporting the tent body 12 in a taught and upright position, and a fabric tent fly 16 that may be attached over the tent body 12 and the tent poles 14. The tent body 12 and the tent fly 16 may be constructed of thin, lightweight, pliable, waterproof materials (i.e., having a high level of hydrostatic resistance), in order to provide a tent 10 that is weatherproof, light weight, and easy to pack and transport. These materials preferably provide at least some degree of light transmission, so as not to unduly interfere with light transmission into the tent enclosure. Suitable materials for the tent body 12 may include, for example, 50 to 210 denier nylon ripstop or plain weave, or any other suitable materials known to one of ordinary skill in the art. In addition, suitable materials for the tent fly 16 may include, for example, 30 to 210 denier polyurethane or silicon coated polyester ripstop or plain weave, 30 to 210 denier polyurethane or silicon coated nylon ripstop or plain weave, or any other suitable materials known to one of ordinary skill in the art.

Still referring to FIGS. 1 and 2, the tent body 12 may include one or more mesh windows 18 and/or vents 20, in addition to one or more zipper-accessible doors 22. The tent body 12 may also include sleeves 24 for receiving the poles 14 and attaching them to the tent body 12, however other structures known in the art, such as clips or elastic cords, may be employed to attach the poles 14 to the tent body 12. In addition, the tent body 12 and/or tent fly 16 may have tie downs 26 attached thereto for staking the tent 10 to the ground, and anchor points 28 provided thereon for attaching a guy line to provide tension in the fabric. Although the present invention is described herein with reference to the tent shown in FIGS. 1 and 2, it should be noted that the present invention is not limited to a tent having the specific shape, configuration, structure or details shown.

Figure 3:
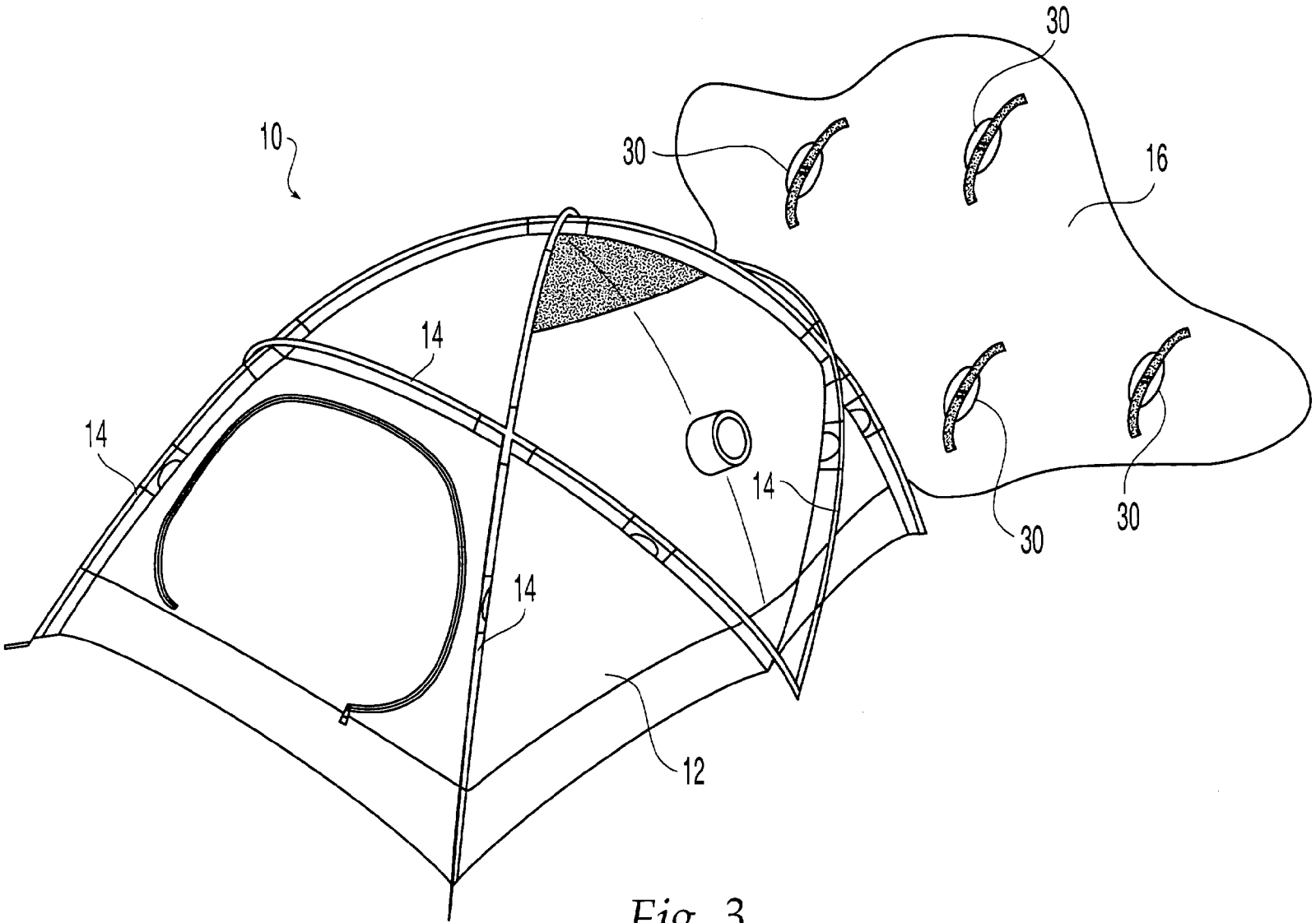
FIG. 3 is a perspective view of the tent and tent fly of FIG. 1, with the underside of the tent fly visible.
Figure 4:
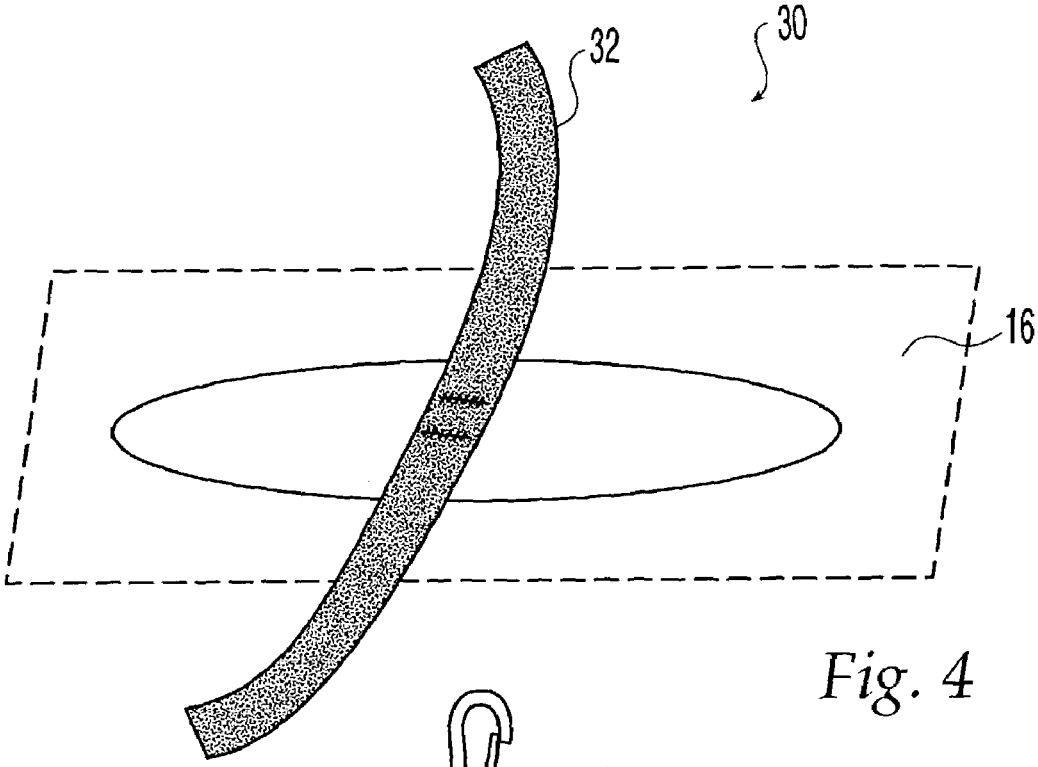
FIG. 4 is a perspective view of one illustrative embodiment of an anchor member of FIG. 3.
Figure 5:
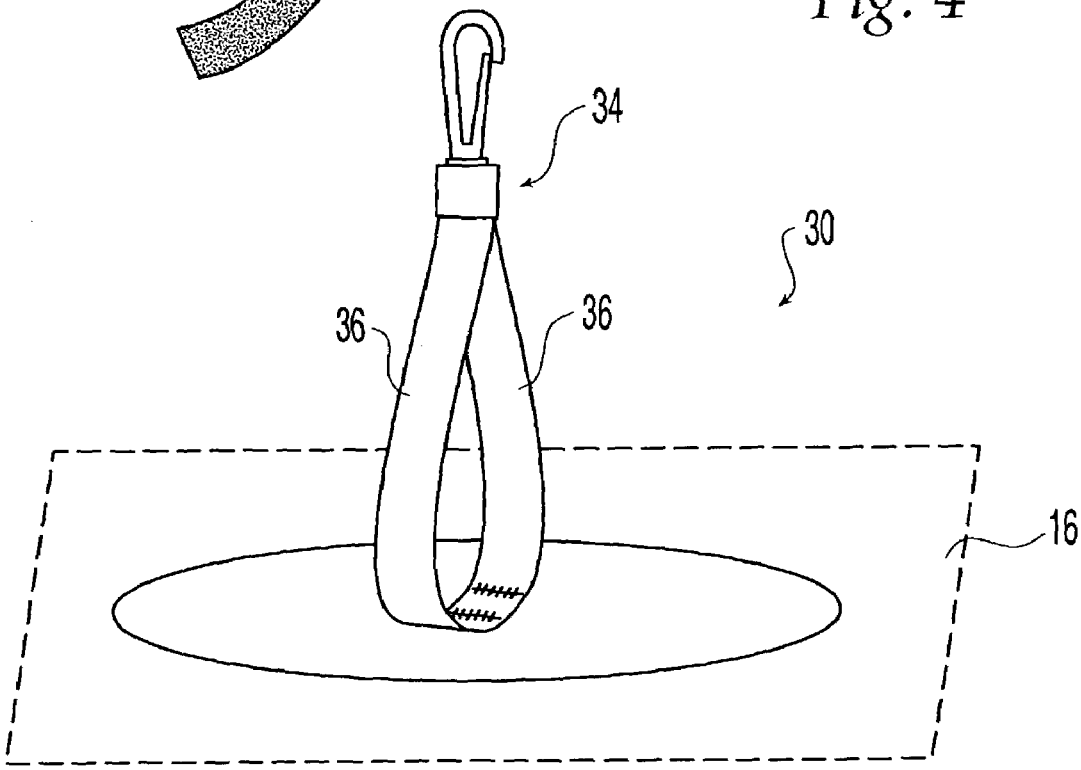
FIG. 5 is a perspective view of another illustrative embodiment of the anchor member of FIG. 3.

Referring to FIG. 3, the underside of the tent fly 16 is shown. The tent fly 16 includes a plurality of anchor members 30 for attaching the tent fly 16 to the poles 14, or alternatively, to the tent body 12. As shown in FIG. 4, the anchor members 30 may comprise a loop 32 of hook-and-loop fastener material (commonly known as VELCRO™) or other materials, such as nylon webbing or elastic cord, attached to the fabric of the tent fly 16. As shown in FIG. 5, the anchor members 30 may alternatively comprise a clip 34 that is attached to the fabric of the tent fly 16 via one or more pieces of webbing 36. In the embodiment shown, the clip 34 is attached using two lengths of webbing 36, so as to evenly distribute the stresses at the webbing/tent fly interface, and so not to create a peel force. One of ordinary skill in the art will know and appreciate, however, that the principles of the present invention are not limited to use with a loop 32 of hook-and-loop fastener material or clip 34, as described above, and may be implemented with any type of anchor member 30.

Figure 6:
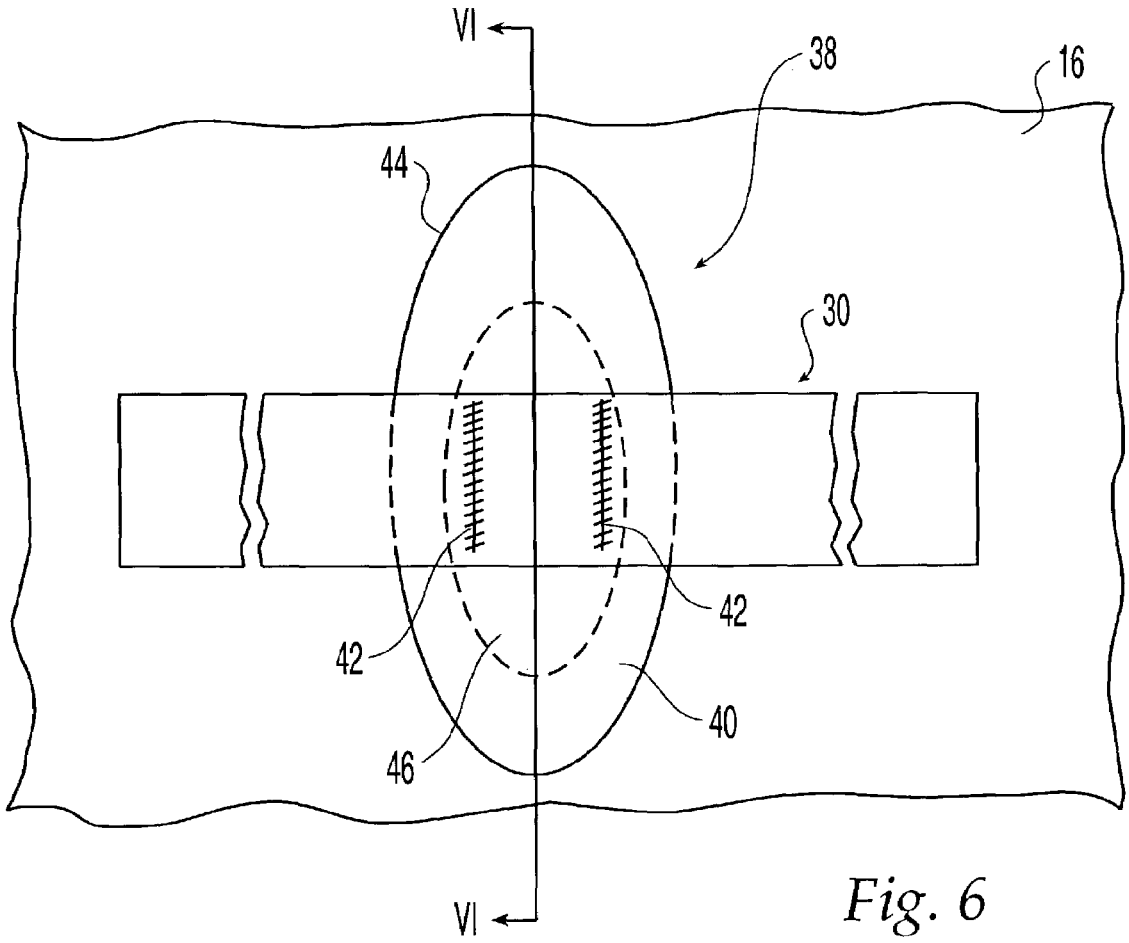
FIG. 6 is a top view of an illustrative embodiment of a waterproof system for attaching the anchor members of FIGS. 4 and 5 to the tent fly or other portion of a tent.
Figure 7:
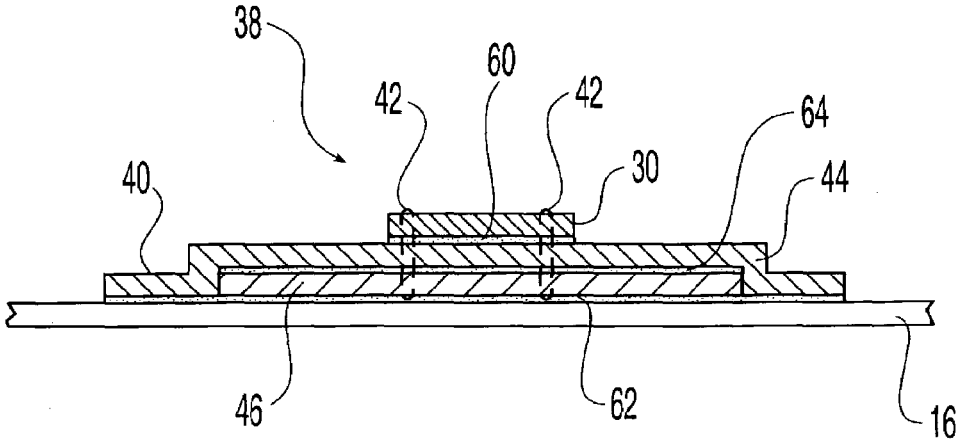
FIG. 7 is a cross-sectional view of the waterproof system of FIG. 6, taken along line VI-VI.

Referring now to FIGS. 6 and 7, an illustrative embodiment of a waterproof system 38 for attaching the anchor member 30 to the tent fly 16 is shown. The system 38 includes a first sheet of fabric, referred to herein as anchor patch 40, that is sewn to the anchor member 30 with one or more rows of stitches 42. The anchor member 30 may be sewn to the top of anchor patch 40, as shown, or alternatively may be sewn to the bottom of anchor patch 40 and extend through the anchor patch 40 through slits formed in the anchor patch 40 on both sides of the stitching. In either configuration, the anchor member 30 may additionally be laminated to the anchor patch 40 with a thin layer of adhesive 60 provided between the two layers in the area surrounding stitches 42, as will be described in more detail below.

Still referring to FIGS. 6 and 7, anchor patch 40 is laminated to the tent fly 16 without any threads extending through the tent fly 16. This results in a waterproof system since there are no thread holes created in the tent fly 16, and there are no threads or other materials extending through the tent fly 16 which may cause water or other substances to wick through the tent fly 16. The anchor patch 40 may be laminated to the tent fly 16 by providing a thin layer of adhesive 62 between the two layers and heat welding them together, the details of which will be described below. System 38 may further include a second sheet of fabric, referred to herein as reinforcement patch 46, that is disposed between the anchor patch 40 and the tent fly 16. Threads 42 may extend through both the anchor patch 40 and the reinforcement patch 46 to provide a stronger connection between anchor member 30 and the anchor patch 40, and thus increase the pull-out strength of the anchor member 30. Reinforcement patch 46 may be laminated to anchor patch 40 using a thin layer of adhesive 64, as will be described in more detail below. Reinforcement patch 46 may also be laminated to the tent fly 16 using adhesive layer 62, as will also be described in more detail below. Laminating reinforcement patch 46 to anchor patch 40 provides for even distribution of stresses from the anchor member 30 to the anchor patch 40 and tent fly 16, and also focuses the stresses on the anchor patch 40 and tent fly 16 in a direction that is normal to the tent fly 16. This is particularly important in cases where the tent fly 16 is constructed of a polyurethane or silicon coated base material, as peel forces (i.e., forces applied to the material in a non-normal direction) tend to remove the coating from the base material, thus weakening the ultimate bond between the anchor patch 40 and the tent fly 16.

Anchor patch 40 may be constructed of 75 to 150 denier nylon or polyester oxford, or any other suitable material known to one of ordinary skill in the art. Reinforcement patch 46 may be constructed of 150 denier nylon or polyester oxford, which provides adequate pull out strength, or any other suitable fabric known to one of ordinary skill in the art.

As shown in FIG. 6, the anchor patch 40 and/or the reinforcement patch 46 (if provided) may be substantially elliptically or circularly shaped (e.g., define a substantially elliptical or circular outer circumference 44) in order to radially distribute the forces transmitted to the tent fly 16 from the anchor member 30. In addition, reinforcement patch 46 may be smaller than the anchor patch 40. The combination of anchor patch 40 with a smaller reinforcement patch 46 provides added pull-out strength to anchor member 30, described above, while minimizing the effects of reduced light transmission and increased fabric stiffness that is caused by the extra layer of material that constitutes reinforcement patch 46.

Figure 8:
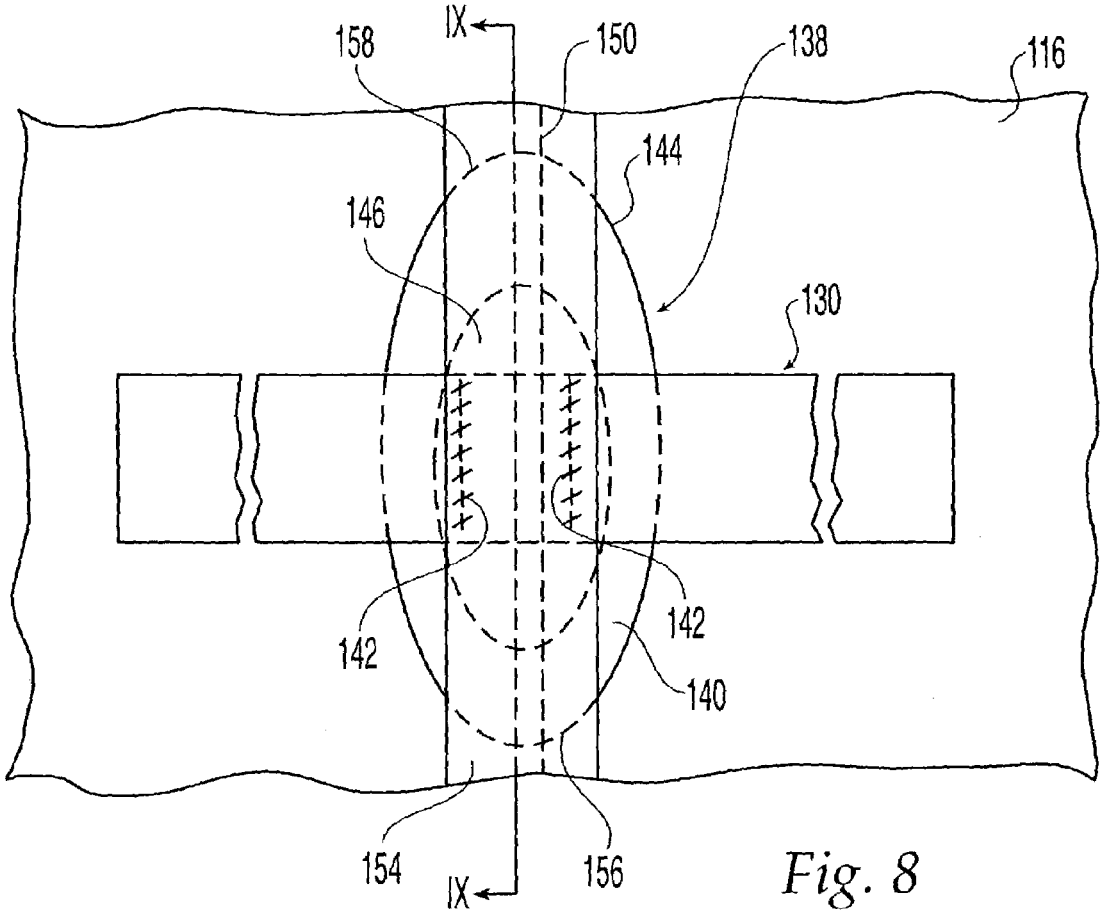
FIG. 8 is a top view of another illustrative embodiment of the waterproof system of FIG. 6, wherein the system is provided on a seam of the tent fly.
Figure 9:
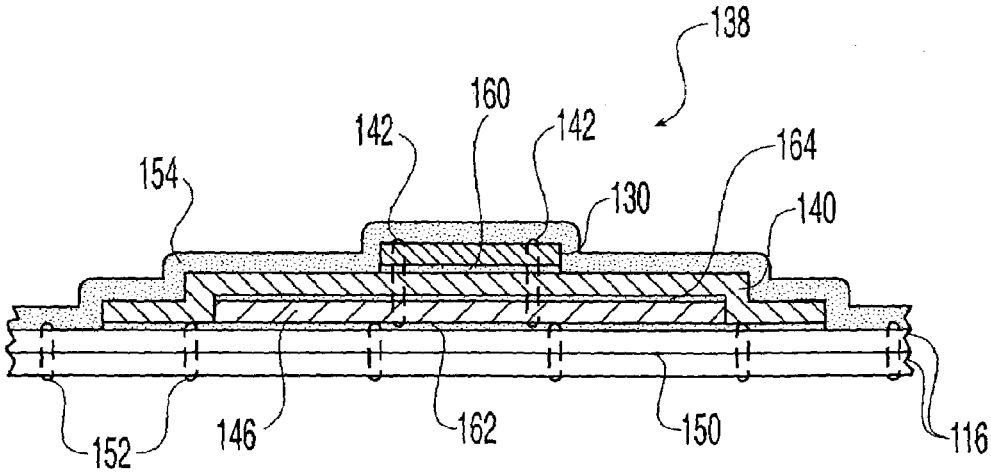
FIG. 9 is a cross-sectional view of the waterproof system of FIG. 8, taken along line IX-IX.

Referring to FIGS. 8 and 9, a second illustrative embodiment of a waterproof system is shown, wherein the system 138 is applied along a seam 150 of the tent fly 116. The seam 150 is of typical construction and may include two or more layers of overlapped tent fly material that is joined by any combination of sewing and/or laminating. In the embodiment shown in FIGS. 8 and 9, the seam 150 is formed by overlapping two layers of tent fly fabric which are laminated together and sewn together with threads 152. System 138 is substantially the same as the system shown in FIGS. 6 and 7, except that the anchor patch 140 is laminated directly over the seam 150. In addition, a strip of seam tape 154 (a layer of waterproof material that is commonly bonded over seams to increase their weather resistance) may be applied along the length of the seam 150, and may extend continuously across the top of the anchor patch 140 and the anchor member 130. According to an alternative embodiment (not shown), the seam tape 154 may run the length of the seam 150, and the anchor patch 140 may be laminated over the seam tape 154, such that the seam tape 154 is located underneath the anchor patch 140. According to another alternative embodiment (not shown), the seam tape 154 may terminate at one end 156 of the anchor patch 140 and resume again at the opposite end 158 of the anchor patch 140.

Figure 10:
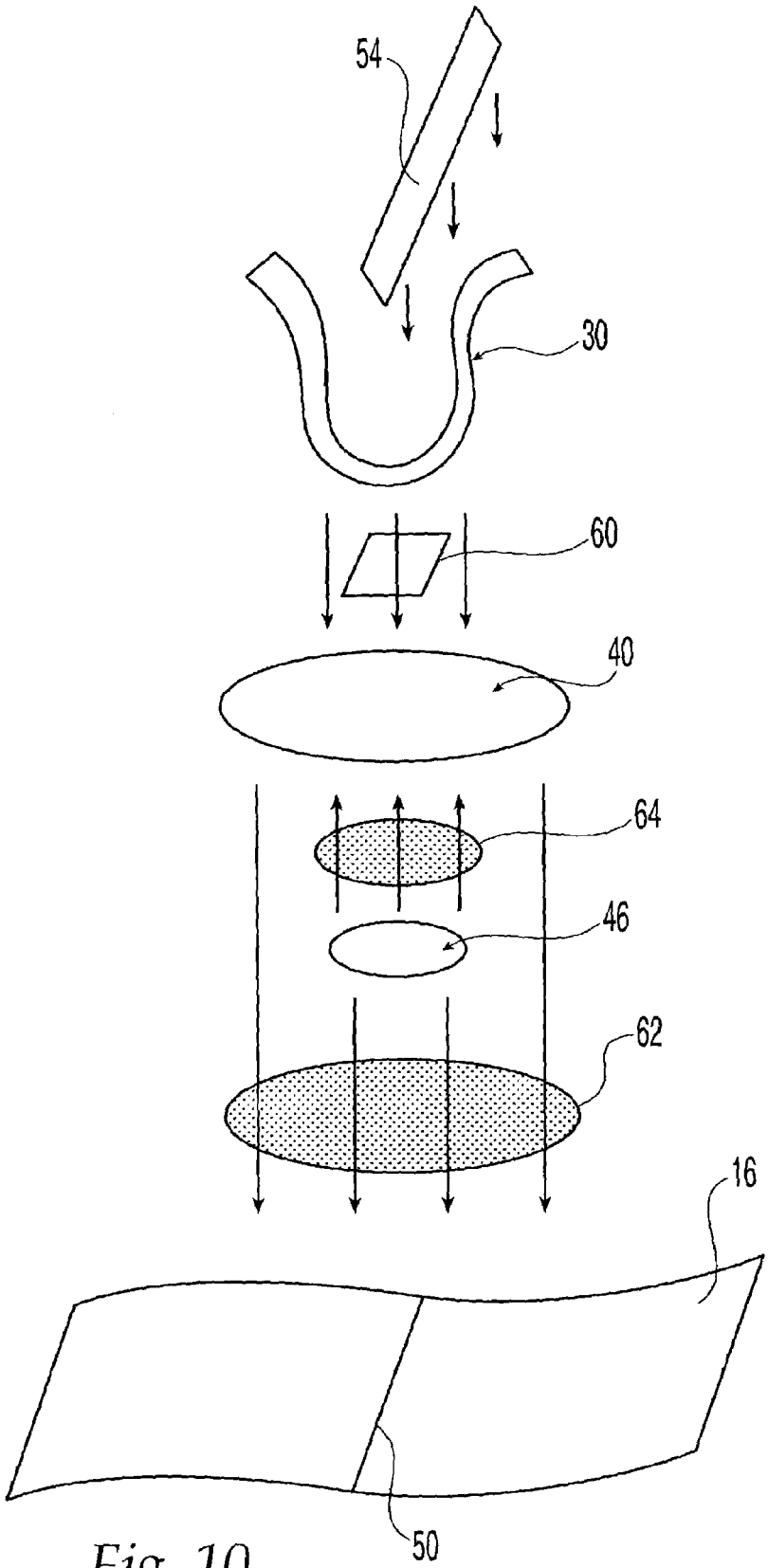
FIG. 10 is a schematic illustration of a method of attaching the anchor member to the tent fly or other portion of a tent, in accordance with the principles of the present invention.

A method of attaching the anchor member 30 to a portion of a tent is shown in FIG. 10 in reference to tent fly 16, although the method may be employed to attach an anchor member 30 to any other fabric portion of the tent 10, such as the tent body 12. The method includes attaching the anchor member 30 to the anchor patch 40 by sewing. For example, one or more rows of thread stitches may be sewn through the anchor member 30 and the anchor patch 40. In addition to the sewing, a thin layer of adhesive 60 may be provided between the anchor member 30 and the anchor patch 40, and heat and pressure may be applied to the assembly to heat weld the two parts together. Suitable adhesives may include polyurethane-based or polyester-based laminating adhesives, such as those marketed by BEMIS ASSOCIATES INC. (Shirley, Mass.) under product numbers 3205 and 3218, or any other suitable adhesives known to one of ordinary skill in the art. The adhesive 60 may be a thin layer of adhesive (e.g., about 0.001" to about 0.01' in thickness) that is provided between the anchor member 30 and the anchor patch 40, or alternatively it may be pre-laminated on to the anchor member 30 and/or the anchor patch 40.

Once the anchor member 30 is attached to the anchor patch 40, the anchor patch 40 may be laminated to the tent fly 16, resulting in a stitchless attachment of the anchor member 30 to the tent fly 16. The anchor patch 40 may be heat welded to the tent fly 16 using a layer of adhesive 62, such as the adhesive described above. The adhesive 62 may be a separate strip provided between the tent fly 16 and the anchor patch 40, or may alternatively be pre-laminated to the tent fly 16 and/or the anchor patch 40. According to one embodiment of the invention, the anchor patch 40 may be heat welded to the tent fly using a pneumatic press at a temperature of between about 250° and 450° Fahrenheit at pressures between about 8 psi and 25 psi., for between five and thirty seconds. The pneumatic press may have pressing surfaces that are of substantially the same size and shape as the anchor patch 40. This allows the press to focus heat and pressure evenly over the entire surface of anchor patch 40, while at the same time dramatically reducing the area of the tent fly 16 surrounding the anchor patch 40 that is heat affected by the heat sealing process.

Still referring to FIG. 10, the method may further comprise providing a reinforcement patch 46 between the anchor patch 40 and the tent fly 16, and optionally, sewing the anchor member 30 to the anchor patch 40 by sewing through both the anchor patch 40 and the reinforcement patch 46. The reinforcement patch 46 may also be heat welded to the anchor patch 40 by providing a layer of adhesive 64 between the reinforcement patch 46 and the anchor patch 40, and heat welding the parts together so as to distribute vertical forces to the subsequent larger surface area below. Adhesive 64 may be the same as adhesives 60, 62 described above, or any other suitable adhesive known to one of ordinary skill in the art. In addition, adhesive 64 may be a separate layer of adhesive, or may be pre-laminated onto the anchor patch 40 and/or the reinforcement patch 46.

The anchor patch 40 and the reinforcement patch 46 may be heat welded together. For example, they may be heat welded together before the anchor member 30 is sewn to the anchor patch 40, or alternatively, they may be heat welded together at the same time that the anchor patch 40 is laminated to the tent fly 16. In this regard, all of the aforementioned heat welding steps may be performed in one single heat welding process, or alternatively, may be performed as separate discrete steps.

The method may also involve welding the anchor patch 40 directly over a seam 50 in the tent fly. In this instance, an additional layer of seam tape 54 may be applied over the seam 50 and across the anchor member 30 and the anchor patch 40. Alternatively, the seam tape 54 may be applied to the seam 50 first, and the anchor patch 40 may be welded over the seam 50 and seam tape 54, such that the seam tape 54 exists underneath the anchor patch 40. According to yet another embodiment, two separate lengths of seam tape 54 may be applied over the seam 50—one length on each side of the anchor patch 40—with no seam tape extending over or under the anchor patch 40 and anchor member 30.

Although the present invention has been described in the context of an anchor member for attaching a tent fly to a tent pole, the principles of the present invention are not limited to this specific application. Instead, the waterproof system and methods described herein may be used to provide any type of anchor, fixture, attachment member, or other accessory known in the art on a fabric portion of a tent such as a tent fly, tent body, or other part of a tent.

While the foregoing description and drawings represent the preferred embodiments of the present invention, it will be understood that various additions, modifications and substitutions may be made without departing from the spirit and scope of the present invention as defined in the accompanying claims. The presently disclosed embodiments are therefore to be considered in all respects as illustrative and not restrictive, the scope of the invention being indicated by the appended claims, and not limited to the foregoing description.

What is claimed:

1. A tent fly comprising:

a fabric portion configured and dimensioned to form an outermost layer of a tent spaced from a tent body;

an anchor member; and an anchor patch sewn to at least a portion of the anchor member with threads and adhesively coupled to the fabric portion;

wherein the anchor patch is laminated to the fabric portion without the threads extending through the fabric portion; and wherein the anchor member and anchor patch are discrete from one another;

further comprising a reinforcement patch disposed between the anchor patch and the fabric portion, wherein the anchor member is sewn to the anchor patch with threads that extend through the anchor patch and the reinforcement patch.

2. The tent fly of claim 1, wherein the anchor patch is laminated to the fabric portion with a Layer of adhesive disposed between the anchor patch and the fabric portion.

3. The tent fly of claim 2, wherein the layer of adhesive is selected from one of the group consisting of polyurethane-based adhesive and polyester-based adhesive.

4. The tent fly of claim 3, wherein the layer of adhesive is pre-laminated onto at least one element selected from one of the group consisting of the anchor patch and the fabric portion.

5. The tent fly of claim 1, wherein the reinforced patch is laminated to the anchor patch with a layer of ashesive disposed between the anchor patch and the reinforced patch, and wherein the adhesive is selected from one of the group consisting of polyurethane-based adhesive and polyester-based adhesive.

6. The tent fly of claim 5, wherein at least one element selected from one of the group consisting of the reinforcement patch and the anchor patch is pre-laminated with the adhesive.

7. The tent fly of claim 1, wherein the reinforcement patch is smaller than the anchor patch.

8. The tent fly of claim 1, wherein the reinforcement patch is formed from a material selected from one of the group consisting of polyester oxford fabric and nylon oxford fabric.

9. The tent fly of claim 1, wherein the anchor patch is formed from a material selected from one of the group consisting of polyester oxford fabric and nylon oxford fabric.

10. The tent fly of claim 1, wherein the fabric portion is selected from one of the group consisting of a portion of a tent body and a tent fly.

11. The tent fly of claim 10, wherein the fabric portion is lightweight, pliable and waterproof.

12. The tent fly of claim 10, wherein the fabric portion is translucent.

13. The tent fly of claim 10, wherein the fabric portion comprises a coating selected from one of the group consisting of polyurethane and silicon.

14. The tent fly of claim 10, wherein the fabric portion is formed from a material selected from one of the group consisting of nylon and polyester.

15. The tent fly of claim 1, wherein the anchor member comprises a form selected from one of the group consisting of a loop of hook-and- loop fastener and a plastic clip.

16. The tent fly of claim 1, wherein the anchor patch is laminated over a seam in the fabric portion, and a continuous layer of seam tape extends along the seam and over or under the anchor patch.

17. A tent fly comprising:

a fabric portion;

an anchor member;

an anchor patch sewn to at least a portion of the anchor member with threads and adhesively coupled to the fabric portion; and a reinforcement patch disposed between the anchor patch and the fabric portion;

wherein the threads extend through the anchor patch and the reinforcement patch;

wherein the anchor patch is laminated to the fabric portion without the threads extending through the fabric portion;

wherein the anchor member and anchor patch are discrete from one another; and wherein at least one element selected from the group consisting of the anchor patch and the reinforcement patch defines an outer circumference having a shape selected from the group consisting of substantially elliptical and substantially circular.

18. A tent comprising:

a plurality of poles;

a tent body attachable to the poles to define a tent enclosure;

a tent fly attachable to the poles in a spaced relationship to the tent body, the tent fly comprising a fabric portion configured and dimensioned to form an outermost layer of the tent; and an anchor member adapted and configured to attach the tent fly to the poles, wherein the anchor member is sewn to an anchor patch with threads, the anchor patch is adhesively coupled to the fabric portion, the anchor patch is laminated to the tent fly such that the threads do not extend through the tent fly, and the anchor member and anchor patch are discrete from one another;

further comprising a reinforcement patch disposed between the anchor patch and the tent fly, wherein the anchor member is sewn to the anchor patch with threads extending through the anchor patch and the reinforcement patch.

19. The tent of claim 18, wherein the anchor patch is laminated to the tent fly with a layer of polyurethane-based adhesive disposed between the anchor patch and the tent fly.

20. The tent of claim 18, wherein the reinforcement patch is laminated to the anchor patch with a layer of adhesive disposed between the anchor patch and the reinforcement patch, and wherein the adhesive is selected from one of the group consisting of polyurethane-based adhesive and polyester-based adhesive.

21. The tent of claim 18, wherein the reinforcement patch is smaller than the anchor patch.

22. The tent of claim 18, wherein at least one element selected from one of the group consisting of the anchor patch and the reinforcement patch defines a outer circumference having a shape selected from one of the group consisting of substantially elliptical and substantially circular.

23. tent of claim 18, wherein the tent fly is constructed of a light weight, pliable, waterproof material.

24. The tent of claim 18, wherein the tent fly is constructed of a translucent material.

25. The tent of claim 18, wherein the tent fly comprises a coating selected from one of the group consisting of polyurethane and silicon.

26. The tent of claim 18, wherein the tent fly is formed from a material selected from one of the group consisting of polyester and nylon fabric.

27. The tent of claim 18, wherein the anchor member is selected from one of the group consisting of a hook-and-loop fastener material and a clip.

28. The tent of claim 18, wherein the anchor patch is laminated over a seam in the tent fly, and a continuous layer of seam tape extends along the seam and over or under the anchor patch.

* * * * *